United States Patent [19]

Touboul et al.

[11] 4,252,558

[45] Feb. 24, 1981

[54] METHOD FOR PRODUCING A PLATINOID COMPRISING A DISPERSED PHASE OF A REFRACTORY OXIDE

[75] Inventors: Jean-Paul Touboul, Rosny sous Bois; Jean-Paul Guerlet, Paris, both of France

[73] Assignee: Comptoir Lyon-Alemand-Louyot, Paris, France

[21] Appl. No.: 48,805

[22] Filed: Jun. 15, 1979

[30] Foreign Application Priority Data

Jun. 20, 1978 [FR] France ..... 78 18441

[51] Int. Cl.[3] ..... C22B 11/00

[52] U.S. Cl. ..... 75/0.5 C; 75/0.5 BB; 75/0.5 BC; 75/252; 75/235; 75/152; 75/172 E; 75/172 R; 75/246

[58] Field of Search ..... 75/0.5 BB, 0.5 BC, 0.5 C, 75/252, 235, 246, 152, 172 E, 172 R

[56] References Cited

U.S. PATENT DOCUMENTS

| | | | |
|---|---|---|---|
| 2,476,222 | 7/1949 | Rhodes | 75/172 R |
| 3,378,392 | 4/1968 | Longo | 75/0.5 C X |
| 3,598,635 | 8/1971 | Sagona | 75/0.5 C X |
| 3,696,502 | 10/1972 | Darling | 148/6.3 X |
| 3,713,270 | 1/1973 | Farr et al. | 75/172 R |
| 4,023,961 | 5/1977 | Douglas et al. | 75/0.5 C X |

FOREIGN PATENT DOCUMENTS

| | | | |
|---|---|---|---|
| 2807587 | 8/1978 | Fed. Rep. of Germany | 75/172 R |
| 47-33546 | 8/1972 | Japan | 75/172 R |
| 1139897 | 1/1969 | United Kingdom . | |

*Primary Examiner*—G. Ozaki

*Attorney, Agent, or Firm*—DeLio and Montgomery

[57] ABSTRACT

The present invention concerns a method for producing a metal from crude platinum or one of its alloys, comprising very fine particles, in dispersed phase form, of at least one refractory oxide, in the proportion of 0.1 to 0.5% by weight with respect to the weight of the said metal, wherein the molten host metallic material containing the said oxide is sprayed on a target by means of a device delivering a jet of pressurized gas.

11 Claims, No Drawings

METHOD FOR PRODUCING A PLATINOID COMPRISING A DISPERSED PHASE OF A REFRACTORY OXIDE

The present invention relates to a method for producing a platinoid comprising a dispersed phase of a refractory oxide.

The platinoids, (or PLATINUM metals) and alloys are widely used in industry to produce parts which are subjected, to high operating temperatures on the one hand, and to very corrosive atmospheres, on the other; such parts are, for example, glass-melting crucibles and spinnerets for producing glassfibres.

The main property of these parts which it is desirable to improve as much as possible is their resistance to hot creep.

And precisely to improve that resistance to hot extrusion, it has already been proposed to incorporate to the metal die constitutive of the said parts, small quantities of refractory additives and mainly, finely dispersed refractory oxides.

A conventional method to produce such parts consists in using the technique of powder metallurgy.

Despite the advances made, it is not possible with said method to obtain, industrially and in reproducible manner, a part which shows an homogeneous distribution of the oxide phase dispersed inside it.

The production of basic powders remains very difficult to control, especially because of the fineness required from the dispersed phase and of the low contents involved. During the preparation of the coprecipitated powders for example, an agglomeration of ultra-fine particles of oxides can be noted at the very beginning of the precipitations, which agglomeration leads to a growth of the phase and, as a result, to a loss of the mechanical properties of the sintered material. Growth of the elementary particles also occurs during the densifying of the compressed block and subsequent treatments of hot working and transformation. In practice, it has proved very difficult to avoid this phenomenon and to obtain, within the same batch or the same sample, a fine enough distribution of oxide particles. However it would seem, that particles with a diameter greater than 0.1 μm have little action on the resistance to creep.

The wet or dry methods for mixing ultrafine particles are virtually never used because of the very poor results they give.

Another process consists in oxidizing then sintering a powder of a platinum alloy with the doping agent (zirconium for example).

But, with the very low diffusibility of the oxygen in liquid platinum, it is not possible to entirely oxidize the doping agent dissolved in the die, which means therefore that no acceptable homogeneity can be obtained reproducibly.

Another method consists in spraying on a target, a molten host material, such as platinum for example, and a reactive constituent, through an atmosphere converting said constituent into a refractory additive forming a dispersed phase contained in the host material when said latter settles on the target.

Said method has proved a substantial advance in the reproducibility of the method and of the resistance to hot creep, but it requires the use of reagents meant to form refractory additives in the conditions set by the method, and especially in the condition of temperature of the flame, which limits the additives that can be used.

Also, with particular reagents, only a very poor or a partial conversion of the reactive product into refractory product can be obtained.

Moreover, the distribution of additive particles in the ingot obtained is sometimes heterogenous and the diameter of the particles may also be too large.

The object of the present invention is to propose a method for producing a metal which may be from platinum or an alloy thereof comprising a dispersed phase of at least one refractory oxide in the form of very fine particles, and with none of the disadvantages of the methods known under the prior art.

This object and other objects are attained with the present invention which indeed relates to a method for producing a metal which may be from platinoids, platinum or an alloy thereof comprising very fine particles, in dispersed phase form of at least one refractory oxide in the proportion of 0.01 to 0.5% by weight with respect to the weight of said metal, wherein the metallic host material, in the molten state, and the said oxide are sprayed on a target by means of a device delivering a jet of pressurized gas.

According to the invention, the metal used as host metal may be from platinum or one of its alloys, i.e. mainly platinum, alloyed with the main platinoids, rhodium, iridium, palladium. By alloys are especially meant the various combinations of those alloys together, such as for example, the commonly used Pt-Rh alloys.

The invention gives some particularly interesting results with pure platinum, and also with platinum-rhodium and platinum-iridium alloys.

It is possible with the method according to the invention to obtain, in easy and reproducible manner, a very homogeneous dispersion of fine particles of refractory oxides in the metal die and, consequently, to produce a part which is more resistant to hot creep.

Compared with the known methods, which call on internal oxidizing of the platinum and of its alloys, the method according to the invention is essentially characterized by the use of a basic product comprising an already oxidized and finely dispersed strengthening phase.

According to the invention, the refractory oxide is used in the form of very fine particles, in the proportion of between 0.01 and 0.5% by weight with respect to the weight of the metallic host material and preferably, between 0.02 to 0.1% especially in the case of yttrium oxide. It is most desirable for the oxide to have a melting point higher than that of the host metal. Preferred rare earth and refractory oxides are yttrium oxides as well as those issued from the elements of columns IIA and IVA of the periodical classification of elements (AFNOR-norm). The preferred oxide is yttrium oxide, but the zirconium, thorium, titanium, calcium, aluminium and hafnium oxides can also be advantageously used.

By very fine particles of refractory oxides are meant particles with preferably a diameter less than 1 μm.

Already known techniques for pressurized blowing of molten metals, so-called flame, plasma or arc techniques can be used as spraying techniques.

Flame blowing, using an oxyacetylene gun, is the preferred technique.

It is also desirable, according to a preferred embodiment, for the oxide at the outlet of the spraying device, to be also in the molten state and not dissociated into metal and oxygen.

According to the invention, the spraying device is directly supplied by at least one powder containing the metallic host material and the oxide, or by a metallic wire prepared by the powder metallurgy technique from the said powder.

To produce the powder, it is preferable to use a physico-chemical method which permits to obtain, homogeneously, either a close mixture of powder from the host material with very fine oxide powder, or a powder from an alloy of the metallic host material which comprises already the dispersed phase of refractory oxide.

The following well-known methods may be used to produce such powders:

(a) Co-precipitating a salt of the host metal and a salt of the metal of the oxide.

(b) Suspending a powder of the host metal in a solution containing the metal of the oxide and then precipitating the refractory oxide in fine particle form, which particles are adsorbed on the powder of the host metal. A preferred powder may be prepared by suspending a fine platinum powder (of Fisher average diameter less than 2 μm) in a solution of yttrium nitrate and then precipitating the yttrium oxide adsorbed on the platinum by adding an alkaline base such as soda.

(c) Calcinating a homogeneous mixture of powder from the host metal with a salt from the metal of the refractory oxide.

It is also possible to start with a mixture of powders and to subject this to the so-called "metal alloying" process, consisting in producing an alloy by mechanical means. This comprises the steps of mixing up ultrafine powders in a bowl filled with steel balls and stirring very strongly. In certain experimental conditions; some very fine metallurgical structures are obtained in which smallest particles cannot be seen under an optical microscope.

The blowing device may be directly supplied with the suitable mixture of powder introduced in a combustible sheath, which may be an advantage whenever the host material includes metals which get partially sintered at high temperatures such as rhodium and iridium.

It is also possible to produce from the said mixture, when using the powder metallurgy method, a metallic wire with which the blowing device is supplied.

According to the invention and due to the fact that before the blowing operation, a mixture or homogeneous and close combination of fine particles of the host material and of the oxide is used, it is possible to obtain, in reproducible manner, on the target, an ingot with a particularly homogeneous phase dispersed inside the host material. The spray of molten host material issued from the nozzle of the gun is generally in the form of a flux of fine droplets. By crashing at impact speeds greater than 50 m/sec, they coat the surface of the mold, so as to constitute a stack of strata about 10 μm thick, each creating an ingot the sizes of which are given by the target. The target is generally made of copper and is cooled. After being removed from the mold, the ingot is machined and heat forged until a rough-shape is obtained with nearly the theoretical density. Said rough-shape is subsequently cold-rolled before being subjected to a treatment for stabilizing the grain.

In the case of applications requiring a high resistance to hot creep, the metals prepared by the process according to the invention have excellent properties and can be used advantageously in the glass industry to produce the commonly used apparatus, such as: spinnerets for the production of glass-fibres intended for heat insulation and soundproofing and for reinforcing plastics, glass fusing crucibles, optical glass refining equipment, molten glass agitators, etc. The metals prepared by the method according to the invention also find interesting applications in the field of containers for laboratory use, and of catalytic gauzes.

Other advantages and characteristics of the invention will emerge on reading the following example given non-restrictively (all the percentages indicated are given by weight).

EXAMPLE 1

(a) A platinum powder containing 0.05% by weight of yttrium oxide is prepared as follows:

a fine platinum powder is suspended (average Fischer diameter: 1.5 um) in a solution of yttrium nitrate, and then a soda solution is added whilst stirring. The yttrium oxide precipitate is adsorbed on the platinum. The doped powder of platinum is washed and then dried at 80° C.

(b) The powder is compacted and sintered for 2 h at 1100°–1300° C. The sintered block is forged at 1100° C. and then drawn into a wire of 1.5 mm diameter.

(c) The wire produced according to (a) and (b) is sprayed by means of an oxy-acetylene blowpipe of the Schoop type and the blown material is recovered in the copper mold which is situated opposite the spray-gun. The pressure of the oxygen and of the acetylene are controlled so as to prevent the dissociation of the oxide and also to keep the flame hot enough to allow the melting of all the particles of $Y_2O_3$. The wire is pulverized until the ingot reaches the desired dimensions. In the case of experimental ingots, the current dimensions are 50×20×10 mm.

(d) The ingot is cold-rolled on the surface, heat forged at 1150° C. until total densifying is complete.

(e) The forged ingot is cold-rolled with no intermediate annealing until cold rolling reduction ($\Delta e/eo \times 100$) are approaching 80%.

(f) The rough shapes are annealed for 30 minutes at 1000° C. and then cold-rolled again by 30%.

Table I below gives the typical values, obtained in cold conditions, for the limit of elasticity (E), the ultimate strength (R), elongation (A%), Vickers hardness under 5 kg ($HV_5$) on test pieces 1 mm thick, of pure platinum, of platinum-rhodium at 10%, and of the alloy of example 1 according to the invention.

Table II below gives the typical values in hours of resistance to hot creep of platinum-rhodium at 10%, and of the alloy of example 1 according to the invention.

The remarkable and unexpected resistance to hot creep of the alloy according to the invention is to be noted, in relation to the Pt(Rh 10%).

EXAMPLES 2 to 4

The same mode of operation as in example 1 is used except that the contents of $Y_2O_3$ are different.

The results obtained are given in table III below, in which are indicated the typical values of resistance to hot creep in hours at 1000° C., under a load of 3.85 kg/mm2 and of Vickers hardness under 5 kg ($HV_5$) on test pieces, 1 mm thick, of alloy according to the invention.

TABLE I

| | Metallurgical State | E (kg/mm2) | R (kg/mm2) | A% | $HV_5$ (kg/mm2) |
|---|---|---|---|---|---|
| Platinum | Cold-rolled ($\frac{\Delta e}{e_o} \times 100 = 80\%$) | 34 | 34 | 0,8 | 88 |
| | Annealed | 7 | 13 | 28 | 38 |
| Pt- Rh 10% | Cold-rolled ($\frac{\Delta e}{e_o} \times 100 = 80\%$) | 53 | 53 | 0,6 | 180 |
| | Annealed | 13 | 29 | 21 | 88 |
| Alloy of example 1 | Cold-rolled ($\frac{\Delta e}{e_o} \times 100 = 85\%$) | 46 | 53 | 3 | 143 |
| | Annealed | 8,9 | 18,9 | 24 | 63 |

TABLE II

| Temperature | 1000° C. | | 1300° C. | | 1450° C. | | |
|---|---|---|---|---|---|---|---|
| Breaking Load (kg/mm2) | 3 | 3,85 | 1,7 | 2,5 | 0,5 | 1,3 | 1,7 |
| Time | | | | | | | |
| Pt-RH 10% | 20–30 | 4–8 | 2,2 | | 2,6 | | |
| Alloy of Example 1 | 100–200 | 20–40 | 100–200 | 10–15 | >200 | 20–40 | 10–20 |

TABLE III

| Examples | $Y_2O_3$ Contents | *$t_R$ BL** | *$t_R$ BL** + annealing at 1000° C. and cold-rolled 30% | Hv(kg/mm2) BL** | Hv(kg/mm2) BL** + annealing at 1000° C. and cold-rolled 30% |
|---|---|---|---|---|---|
| 2 | 0.028% | 25–50 | 50–100 | 50–58 | 55–65 |
| 3 | 0.036% | 20–60 | 50–100 | 50–60 | 55–65 |
| 4 | 0.085% | 17–25 | 25–55 | 48–50 | 45–58 |

*$t_R$: resistance to extrusion at 1000° C. under a load of 3.850 C. in h.
**Bl: as laminated

What is claimed is:

1. A method for producing a metal from a host material comprising one or more platinoids, including platinum, or an alloy thereof, which contains very fine particles of at least one refractory oxide, in the form of a dispersed phase and the proportion of 0.01 to 0.5% by weight of the weight of said metal, wherein molten host material is sprayed on a target by means of a device delivering a jet of pressurized gas.

2. A process as claimed in claim 1, wherein the said oxide has a melting point higher than that of the metallic host material.

3. A process as claimed in either claim 1 or 2, wherein the said oxide is selected from rare earths and yttrium oxide and from the oxide listed in columns IIA and IVA of the periodical classification of elements (AFNOR norm).

4. A process as claimed in claim 1, wherein the said metal may be pure platinum, or a platinum-rhodium alloy, or a platinum-iridium alloy.

5. A method as claimed in claim 1, wherein the said oxide is yttrium oxide.

6. A method as claimed in claim 1, wherein the oxide delivered by the spraying device is also in the molten state.

7. A method as claimed in claim 1 wherein the oxide, delivered by the spraying device is in a non-dissociated state.

8. A method as claimed in claim 1 wherein the spraying device is directly supplied by at least one powder containing the metallic host material and the oxide, or by a metallic wire prepared from the powder by the powder metallurgy method.

9. A process as claimed in claim 8, wherein the said powder is prepared by suspending a fine platinum powder in a solution of yttrium nitrate and by precipitation of the yttrium oxide and absorption of said latter on the platinum by addition of an alkaline base.

10. A method as claimed in claim 1, wherein the said spraying device is an oxy-acetylene flame gun.

11. A method as claimed in claim 10, wherein the metal obtained contains between 0.02 to 0.1% of yttrium oxide.

* * * * *

UNITED STATES PATENT AND TRADEMARK OFFICE

CERTIFICATE OF CORRECTION

PATENT NO. : 4,252,558

DATED : February 24, 1981

INVENTOR(S) : Jean-Paul Touboul, et al

It is certified that error appears in the above-identified patent and that said Letters Patent are hereby corrected as shown below:

In the Abstract

Line 4, "0.1" should be -- 0.01 --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*